US011851249B2

(12) United States Patent
Urciuoli et al.

(10) Patent No.: US 11,851,249 B2
(45) Date of Patent: Dec. 26, 2023

(54) CONTAINER WITH LID LOCKING FEATURES

(71) Applicant: Direct Pack, Inc., Azusa, CA (US)

(72) Inventors: Robert P. Urciuoli, Paso Robles, CA (US); Craig R. Snedden, La Canada Flintridge, CA (US)

(73) Assignee: Direct Pack, Inc., Azusa, CA (US)

( * ) Notice: Subject to any disclaimer, the term of this patent is extended or adjusted under 35 U.S.C. 154(b) by 99 days.

(21) Appl. No.: 17/179,951

(22) Filed: Feb. 19, 2021

(65) Prior Publication Data

US 2022/0267055 A1 Aug. 25, 2022

(51) Int. Cl.
*B65D 43/16* (2006.01)
*B65D 51/18* (2006.01)
*B65D 51/16* (2006.01)

(52) U.S. Cl.
CPC ..... *B65D 43/161* (2013.01); *B65D 51/1622* (2013.01); *B65D 51/18* (2013.01); *B65D 2251/0021* (2013.01); *B65D 2251/0093* (2013.01)

(58) Field of Classification Search
CPC .. B65D 43/161; B65D 51/1622; B65D 51/18; B65D 2251/0021; B65D 2251/0093
USPC ..... 220/367.1
See application file for complete search history.

(56) References Cited

U.S. PATENT DOCUMENTS

| | | | | |
|---|---|---|---|---|
| 4,079,567 | A * | 3/1978 | Spruyt | B65D 77/2092 53/412 |
| 5,456,379 | A * | 10/1995 | Krupa | B65D 43/162 206/508 |
| 9,067,347 | B2 * | 6/2015 | Naber | B29C 66/81463 |
| 9,403,614 | B2 * | 8/2016 | Vanmechelen | B29C 51/306 |
| 10,000,303 | B2 * | 6/2018 | Malcolm | B65D 43/162 |
| 2016/0207670 | A1 * | 7/2016 | Chou | B65D 43/0235 |

* cited by examiner

*Primary Examiner* — James N Smalley
(74) *Attorney, Agent, or Firm* — Frost Brown Todd LLP

(57) ABSTRACT

A container is disclosed herein. The container includes a base and a lid, with the lid being movable between an open position and a closed position. The lid includes a first resealing feature defined by an inner lip and a second resealing feature defined by an outer lip. The resealing features are configured to connect when the lid is in moved into the closed position and disconnect when the lid is moved into the open position. Thus, the lid is releasably held to the base when the lid is closed. The lid incorporates a film layer for reducing waste and weight. The film layer is situated and sized to define a vent into the interior of the base to allow any products disclosed therein to be vented and non-airtight.

19 Claims, 13 Drawing Sheets

CONTAINER WITH LID LOCKING FEATURES

BACKGROUND

Disposable containers for packaging, distributing, displaying or otherwise housing consumer items, especially perishable foods, are becoming increasingly important. Historically, perishable products were brought to market and sold quickly to avoid loss due to exposure to natural elements causing ripeness and eventual decay.

The advent of plastics resulted in many products being wrapped or packaged in plastic, both in the form of flexible plastic bags and solid plastic containers. The use of plastics in the modern-day convenience food industry has significantly improved the "shelf life" of perishable products, allowing both merchants and their customers to store the products for longer periods of time, resulting in substantial savings, and greater distribution.

In addition, consumers may prefer to visually inspect the food product within such containers prior to purchase. Thus, fabricating containers from clear see-through plastics is desirable. For example, packaging provided for bakery goods or agriculture products has often been in the form of clear, plastic clamshell packaging, because, among other things, such clear, plastic clamshell packaging, provides a baked-on-the-premises or homegrown image that grocery retailers have found to be especially appealing to consumers.

Typically, plastic containers will include a fairly rigid lid and base. Ideally, the lid should be capable of properly and effectively sealing the container, yet the container should be constructed so that the lid is relatively easy to remove, and in some circumstances, replace, since it may be expected that the container and lid would be reused. In addition, the lid should provide adequate space for product branding and meeting regulatory product identification (e.g., identification of the product, place of product origin, weight, etc.) in the form of a label that may comprise paper, plastic or both. Typically, these containers are either pre-labeled or labeled after the product is filled in a secondary application.

The advancement in the aforementioned types of containers has significantly increased availability of healthy food options and decreased the cost and spoilage of fruits and vegetables; however, their existence has also increased the amount of rigid plastic present in our waste stream each year. The amount of non-recycled rigid plastic containers has reached epidemic levels and has led to many cities and states in North America and Europe creating new recycling guidelines and laws both restricting use and attaching monetary penalties for overuse.

It has been found that viable options to reduce the amount of rigid plastic used each year are few, relatively expensive, and often impractical taking into consideration the initial capital investment in equipment needed to execute the conversion. In addition, these solutions have often lacked re-closeable features resulting in comestible products becoming dried out, especially in circumstances where more than one serving of a comestible product is contained therein. Moreover, these solutions have failed to allow stacking of the containers within consumer refrigerators.

To address these problems, one solution has been to utilize "lidding" film. Lidding film may seal a rigid container without requiring the use of a rigid lid. For example, lidding film is currently used to seal microwaveable dinners in a rigid container. However, such use of lidding film is characterized by a number of problems. For example, the equipment needed to heat seal film to a rigid container may cost hundreds of thousands of dollars, and typically runs at half the speed of current rigid automated closure lines. Another disadvantage of using lidding film is that it is typically not resealable. Moreover, it is very expensive to ventilate lidding film and align the resulting perforations to increase the breathability of comestible products in the container. In light of the foregoing, utilizing lidding film, particularly in the fresh food industry, would be difficult and costly.

Another example of a film-based solution is the flow wrap bag. For more than a decade, European produce companies have used the flow wrap bag as a combination of rigid elements combined with film elements as a wrapping solution. When compared to a traditional clamshell of similar shape and size, the flow wrap bag results in the reduction of rigid plastic utilization. However, this solution is characterized by its own disadvantages, including but not limited to, the fact that the film bag requires an automated machine for application and once opened cannot be closed like a rigid container.

Each of the aforementioned solutions lacks any rigid structure within their film components, and as such, the act of resealing or closing may be difficult. Moreover, unsupported films may convey a cheap or flimsy feel to the consumer. Based at least upon the foregoing, use of film components with rigid structures would seem to be undesirable for companies seeking to preserve their brand name and the perceived value of the food products within.

Although each of the two solutions mentioned above may be used for a centralized processing facility, or a single growing footprint or region, there are considerable limitations and disadvantages when utilizing these film-based solutions across a large growing footprint, such as across North America and/or Europe. The major disadvantage to these types of solutions is the machinery needed to apply the film. It simply isn't practical or cost effective to transport expensive machinery from one growing region to another, which might require growers to have multiple machines in place and running as one growing region is winding down and another is just starting to produce. Produce items must be packaged quickly, transported to coolers to preserve freshness, and then shipped to retail within hours, so flexibility and speed are critical.

The current preferred non-film packaging solution is the single piece hinged clamshell, and although effective and less costly then the film solution, it adds millions of extra pounds of plastic to the waste stream each and every year. Additionally, these hinged containers are prone to popping open at retail, often resulting in slip and fall accidents as fruit like tomatoes and blueberries roll across produce isles. As a result, many retailers have made it mandatory for growers to apply a secondary tape application across the lid and base of a container to ensure that the container won't inadvertently pop open. Yet, these hinged containers often pop open on automated packing lines just prior to the tape station causing expensive shutdowns and restarts of packing equipment and scales.

Thus, there is a compelling interest in the development of containers having: consumer-preferable design elements, such as: tamper evidence, sealed containers that don't pop open, recloseability features that are reliable and easy to operate, that use a considerably less plastic and that remain friendly to pack, stack, close and open.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
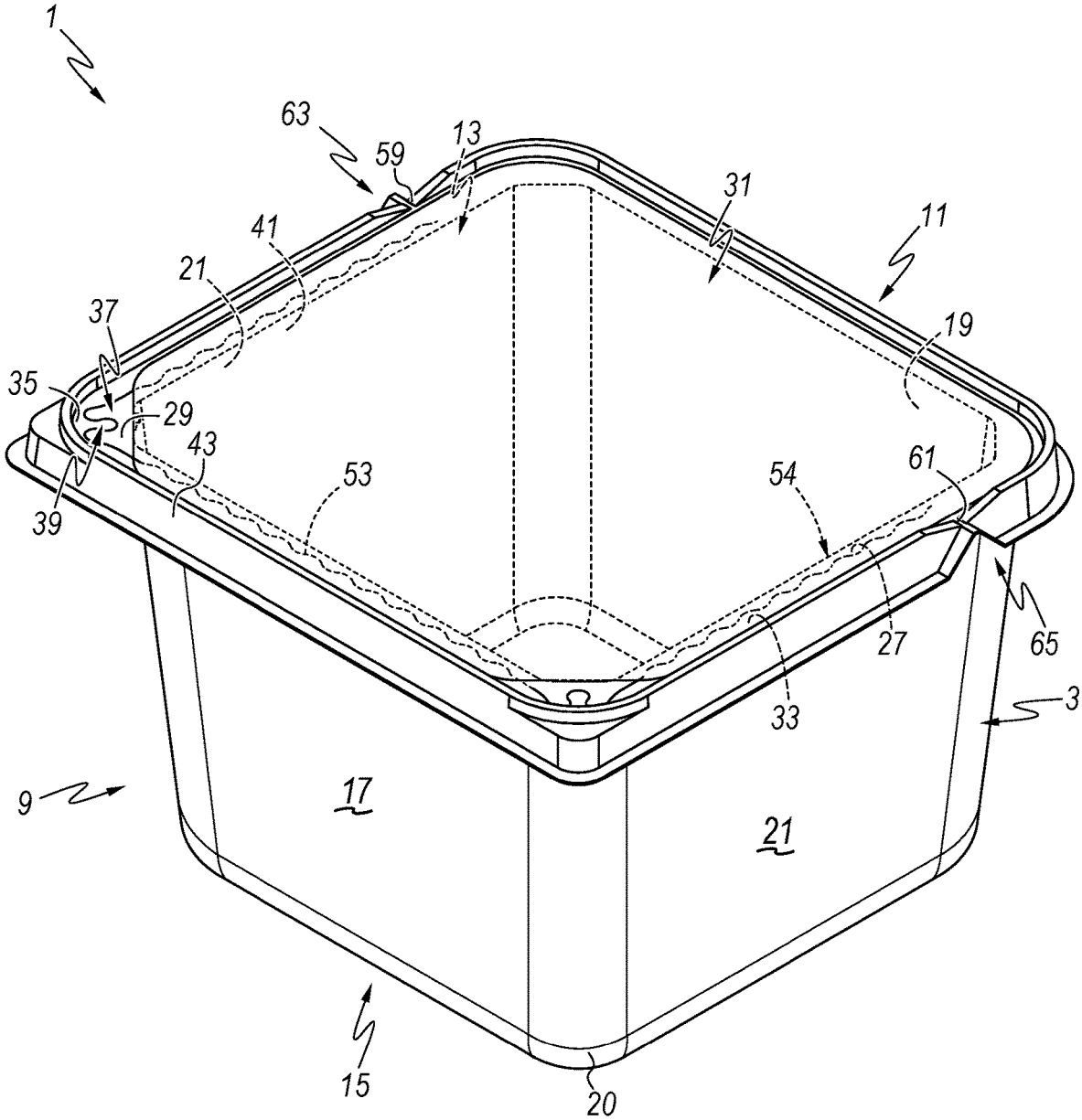
FIG. 1 depicts a perspective view of an exemplary container of the present disclosure in the closed position.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It will be appreciated that any one or more of the teachings, expressions, versions, examples, etc. described herein may be combined with any one or more of the other teachings, expressions, versions, examples, etc. that are described herein. The following-described teachings, expressions, versions, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

I. Rigid Base

Containers according to the present disclosure comprise a rigid base. Non-limiting examples of useful rigid bases include currently marketed clamshell bases or tub bases. Such clamshell bases or tub bases may comprise: a flat or ribbed bottom, rigid side walls, a vented or non-vented base and/or side walls, ribbed or smooth wall structures intended for structural integrity as well as clear visibility of product, and combinations thereof. Rigid bases according to the present disclosure may differ from current clamshell and tub bases, since the rigid structure comprises a rim structure; this rim structure is designed to work in conjunction with a film lid and to act as a unitary package.

The rim structure may take any suitable shape or size and may comprise a series of perforations running along the rim of the container. The rim structure may further comprise a rigid pull tab corner or center. The perforations may be of any suitable length, pattern, or shape, so long as they provide a means to tear at least a portion of the rim structure away from the rigid base, either along a portion of, or along the entire, rim area. Without wishing to be bound by theory, the purpose of the perforated section or perforated entire rim is to rip away from the base when the consumer lifts up from a portion of the rim, e.g., a specific corner such as a tab corner, of the container, so as to provide a rigid structure or skeleton frame to the film lid, which is otherwise sealed onto the container rim.

Figure 2:
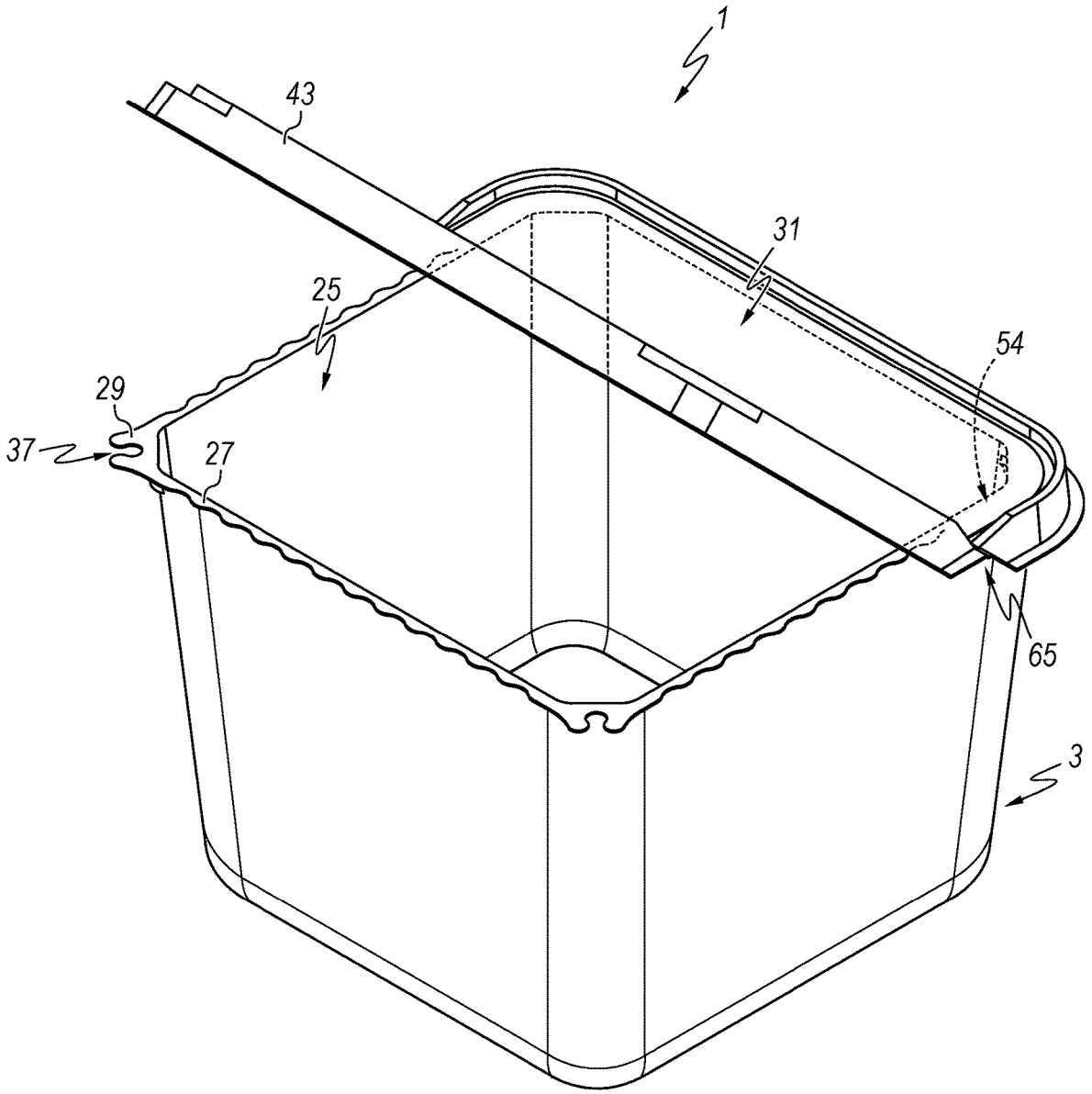
FIG. 2 depicts a perspective view of the container of FIG. 1 in the open position.
Figure 3:
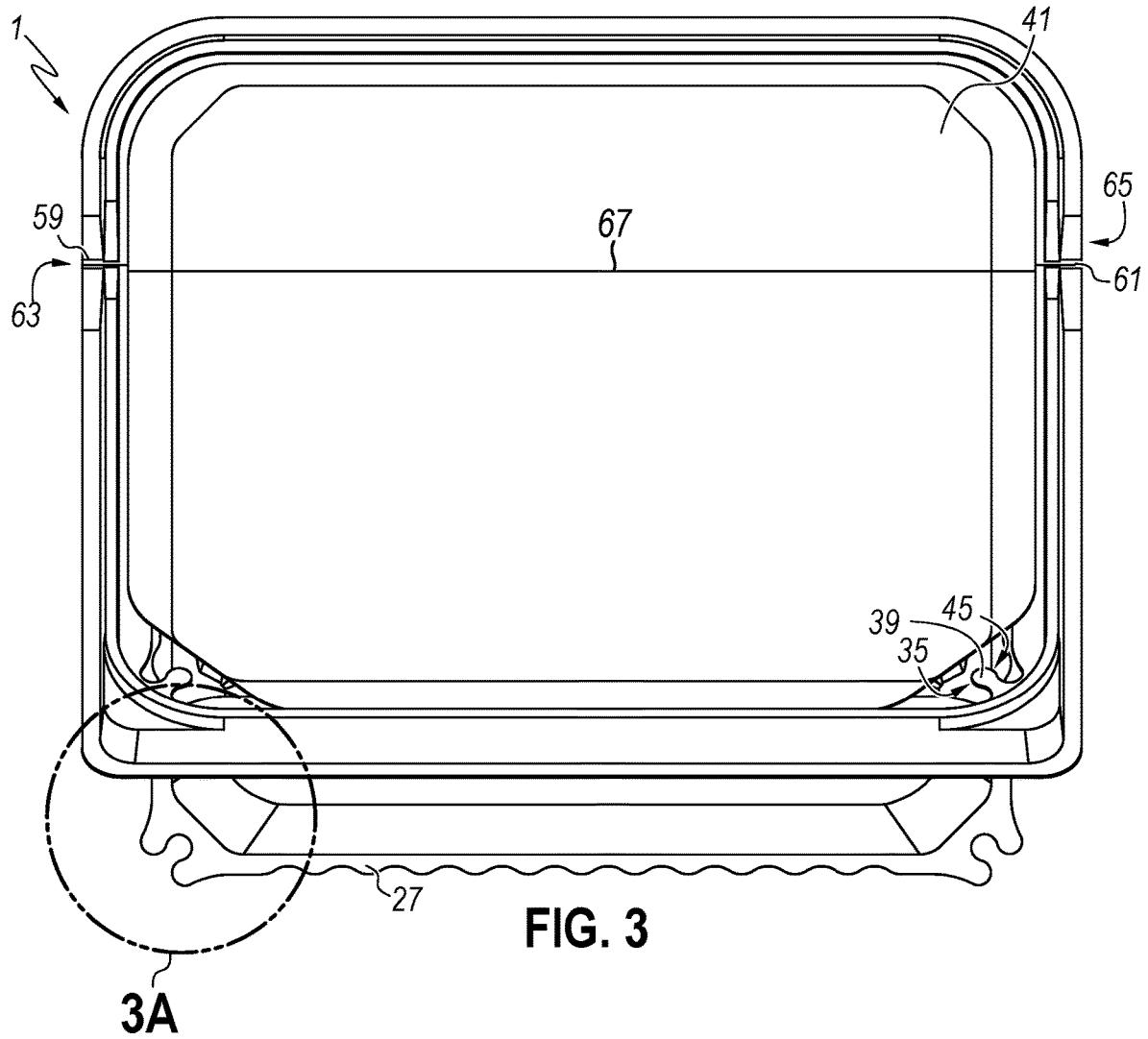
FIG. 3 depicts a top plan view of the container of FIG. 2.
Figure 3A:
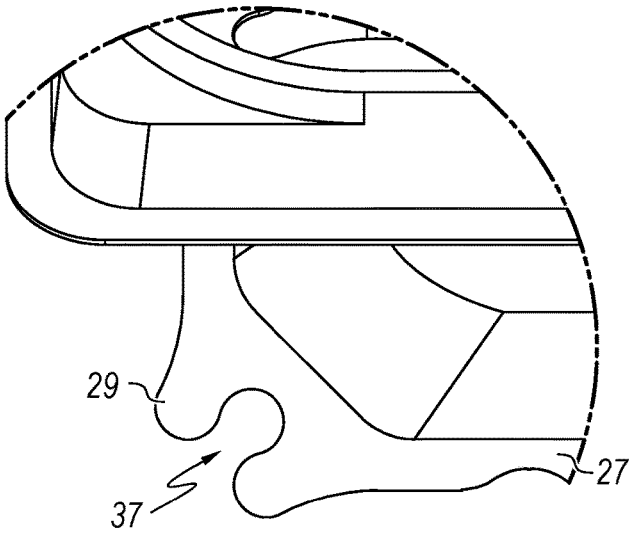
FIG. 3A depicts an enlarged view of a portion of the container of FIG. 3.

The rigid structure or skeleton frame is designed to either flip open and hinge along the rim base at the end of the perforations on either side of the container thus creating both a flexible and rigid flip lid structure (as shown in FIGS. 1 and 2), or it can be completely separated into two pieces, the rigid base, and a flexible lid with a skeleton rigid frame (not shown). These two embodiments may provide growers and processors two separate options when packaging fresh produce, processed fruits and vegetables, or other food products. For example, a personal single-serve salad bowl with a generic two-piece plastic container, a tub and lid, may now be converted into a one-piece tub with a perforated rim and a flexible film lid applied by an automated application method. The present embodiments may also include the desirable feature of the film not being required to separate from the tub rim frame at any time thus reducing any possible tears or the need of applying a heavier gauge film structure to act as a lid.

II. Film Lid

The film lid may have a structure comprising single or multiple layers of film. The structure is designed to act as a rigid lid and to replace all of its intended purposes. The film lid may be printed prior to assembly to the base, such as with product branding, product information including but not limited to, state and federal regulations of product, identifiable product codes and combinations thereof. Printing of the film may desirably eliminate the need for paper labels entirely as the film lid now becomes the label as well. After printing and die cutting of the film it may be wound onto rolls for automatic application to the base structure. Non-limiting examples of film application methods include: a roller-based action pinching of the film to the flat perforated area of the rigid base utilizing a semi-permanent adhesive as the bond, and/or a tamp-on air cylinder actuating plate method which acts by pushing or attaching the film to the perforated rim area of the container by applying pressure to the container.

The film structure may be sealed to both sides of the perforated area on the rim of the container with an adhesive bond. The primary seal is bonded to the outer most portion of the perforated area called the skeleton or frame. The primary seal is the largest sealing area and may allow the entire film structure to be lifted off with the skeleton or frame. The seal rim area may be specifically designed for the shape and size of each rigid base to ensure that it will adequately reclose. The design features of the present container embodiments may mimic those of a rigid clamshell or a two-piece container without the need for the rigid lid, thus reducing the overall plastic weight by 35-40% and additionally eliminating the need for paper labels. The film lid may be specifically designed for its corresponding base container and may be vented in a pattern or non-vented depending on the specific commodity intended for its use.

The rigid base and its film lid are intended to work in conjunction with one another when the film lid is attached to the rigid base through several attachment methods: film application through roller method, and/or a tamp-on applicator. In any case, the film structure may be pulled tight across the rim of the rigid base by the application method, and may result in a tight film lid capable of having multiple containers stacked on top of itself, such as during shipping, at retail, and in the consumer's home. Additional cut outs on the film may link up with male stacking posts on the rim to ensure that containers nest at retail whenever possible. The support stakes and matching lid film holes are also designed to release when pulled up and to re-lock when pulled down again creating a multi-use sealable stacking container.

The film liner may be comprised of one or more layers of any suitable film. Suitable films may include for example, film additive technology such as ethylene scrubbing technology or antifungal additives to further increase "shelf life" and product value. Use of such films eliminates the need for gluing expensive ethylene absorbent pads into the bottom of clamshells and/or tubs to increase "shelf life". Adding ethylene scrubbing technology to the bottom surface of the film lid may also be more effective in reducing ethylene levels within the package as ethylene is lighter than air and will naturally come in contact with the film liner structure as ethylene fills the container from the natural ripening of fruit.

The use of such a film as a lid and all its related properties may replace the need for: a hinged or two-piece rigid plastic solution, a base with a bag, or a lidding film with a tray; thus reducing the overall plastic in waste streams by as much as 35-40% without added cost and machinery. The overall reduction in plastic may impact waste streams by millions if not tens of millions of pounds of plastic. In addition, the film lid may be removed from the base of the container by pulling it from the base where it was adhesively sealed resulting in a 100% recyclable base without any labels or other material attached thereto, unlike current labeled rigid containers.

In addition, the film layer is weight bearing to allow a plurality of containers to be stacked on top of each other. Vertical stacking strength may be needed for these containers to be nested on top of each other either in shipping, while stacked at retail displays, or stacked within the consumer's home refrigerators. The weight bearing component of the film layer structure can be of a variable thickness, a family of adhesives, both direct and indirect food grade contact materials, and of various viscosities in cold temperatures. The strength of the film layer may vary depending on the product used with the containers.

For example, a container with a weight bearing load of under 1 lb. may function and process differently than a container with a weight bearing load of greater than 1 lb. The containers may be differentiated by size, shape, sealing area, purpose, processing, application speeds, retail display configurations, shelf space formats, etc. Products that contain less than 1 lb. are traditionally single serve or limited use containers that may or may not contain juice or liquid. The weight of the product inside generally helps to differentiate the purpose of the container and necessary film layer needed. For example, a container with 6 ounces of washed and ready to eat grapes that contains a small amount of liquid may need to be air and water tight during the short consumption window after opening, whereas containers with more than 1 lb. of washed and ready to eat grapes may be enjoyed over time such that the container may need to be air and water tight for a greater length of time and after each opening and closing of the container. With that noted, smaller containers may have smaller weight bearing loads versus larger weight bearing containers designed to be used over time. Because film layers of increasing thickness may cost more than a thinner layer, it may be desirable to apply a film layer with the minimum thickness needed for a given application to reduce packaging costs on the smaller single serve containers.

Products that are not ready to eat and are generally larger than 1 lb. function primarily as a serve as needed container. An example of this would be 2 lbs. of field asparagus. Consumers typically do not eat or cook these larger amounts of product at one time and may want these containers to be sealed again and again after the initial dispensing of product, so a resealable indirect food grade film layer may be needed. When the container is designed to be air and watertight at time of packing, the container may also be air and watertight when it is re-sealed after opening to ensure that the product does not dry out, leak, or have a considerable loss of shelf life.

To accomplish such a wide and varying spectrum of products and applications, products can be classified into separate categories of film layers that match corresponding products and weight bearing specifications. During the product development stages of each package a sufficient film layer solution is determined for the specific application needed.

A printing press may be used to print information on the outermost surface of the film layer. The clear face stock is designed to replace the need for all paper or plastic branding and product info labels. Rolls are printed with a high graphic printing press and die cut to the shape and size of the container. Prior to the application of the flexible film, the film may be printed with several key product codes, trace information, QR Codes, and any other product information or origin of product needed to meet regulatory demands. A plain BOPP face stock may be printed directly with ink or an imprintable varnish may be used as a topcoat to enable a thermal transfer process to print directly on the container. The ability to print a variable data trace number, origin of product, product specifications, and/or a QR Code, in addition to branding and product specifications, directly to the container at the time of sealing is advantageous. Currently containers are pre-labeled with such track and trace labels and these containers must be kept sequential in nature and cannot be mixed or changed, whereas printing directly onto the container's flexible film lid at the point of sealing changes the need for pre-labeling and storage of said containers. This allows for manufacturers of products, growers, and food processors to automate their packing lines and their label capabilities all in one step. This process also eliminates any doubt as to when the product was labeled and printed with trace data, as the product is now printed at the time of sealing and not at a packaging company months earlier and stored prior to packing.

The structure of the pressure sensitive label being on rolls lends itself to several methods of high-speed application. A rotary plate and/or rail application method may place each label on a rigid rim structure across the base of the containers to seal the containers. These applications may run at speeds of up to about 200 parts per minute. A label applicator system may be supported by support rails and a series of rollers that may apply the labels firmly onto the container's sealing area with a high degree of accuracy and pressure. Both of these application methods are designed to be about 6 feet in length and several feet wide and easily configured onto any high-speed packing equipment or processing line.

A standard heat seal machine application method may also be used to place each label within a rigid rim structure across the base of the containers. In some instance, the heat seal machine may seal the containers at speeds of up to about 60 containers per minute. Any heat-sealing machine may be used to seal the containers, but sealing plates designed to seal across a wider point or at two points may be used.

Perforations may be made as undercuts on the bottom of the rim of the container so that when the container is opened, any sharp edges where the rim and lid separate are in an area that do not come into contact with a consumer's hand. In some versions, the skeleton frame of the base of the container comprises a lip that overhangs a portion of the side wall of the base. Perforations are then cut between the skeleton frame of the base and the re-seal portion of the base. The perforations may be cut in a wave pattern, but any other suitable pattern may be used. When the container is opened, the skeleton frame of the base separates from the re-seal portion of the base. The exposed nicks from the breaks in the perforations are positioned on the skeleton frame of the base, under the overhang and away from the consumer's hands. The re-seal portion of the base includes hidden nicks from the perforations so that the consumer does not contact any sharp edges.

A container of the present disclosure may comprise an integral, hinged film lid. The base of the container may comprise one or a plurality of recesses having various shapes and sizes to simultaneously accommodate various products within the container. Any suitable number of recesses may be used and the recesses and/or the base may comprise any shape and/or size. The base further comprises a skeleton frame with perforations extending along a front of the base to the sides of the base. It should be noted that the perforations of the base can extend along any portion of the base to create an opening for the container, and may extend along the entire portion of the base to create a separate lid. In some versions, the base comprises a living hinge at the end of the perforations. Accordingly, when the skeleton frame is pulled away from the re-seal flange of the base, the living hinge allows the skeleton frame and the film to be rotated about the living hinge to open the container. This allows the container to include hinge capabilities along any angle or radius. The lid may then be lowered to the re-seal flange of the base.

In some instances, the base and/or the flexible film of the container can be vented in macro and/or micro venting patterns. Each pattern or venting structure is designed to meet either the cooling specifications or respiration rates of the product within. Almost all food products can have their shelf life extended by the means of reducing cooling times or controlling the flow of respiration and oxygen transfer rates between the product and its surrounding environment. The venting structure is intended to mimic the venting specifications of a standard rigid container with either a clamshell or two-piece structures.

In some embodiments, the skeleton frame of the base comprises a corner of the base. For instance, an embodiment of the invention may include a base and film lid having perforations cut transversely across a corner of the base. Accordingly, a user may grasp the corner of the container having the perforations and pull upwards on the corner. This may cause the perforations to separate to allow the corner of the base to separate with the remaining portion of the base and pull the film lid away from the base of the container to open the container. The corner of the base thereby remains with the film of the container and may provide tamper evidence. If desired, the film lid can be re-connected with the remaining portion of the rim of the base by pressing the film lid against the rim to re-secure the lid to the base.

In the illustrated embodiment, the perforations are provided in a wave pattern. Accordingly, when the corner of the base is lifted to separate the skeleton frame with the remaining portion of the base, the corner of the base comprises hidden nicks from the perforation separation underneath the film such that the nicks do not contact a user's hand. The remaining base portion then has a smooth cut without any nicks.

III. Exemplary Containers

A. First Exemplary Container

FIGS. 1-5 depict a container (1) with lid locking features in accordance with the present disclosure, hereinafter referred to as container (1). Container (1) is comprised of a base (3) and generally includes a front side (9), a rear side (11), a top side (13), and a bottom side (15). Base (3) comprises a front wall (17), a rear wall (19), two laterally-opposed sidewalls (21) extending therebetween, and a bottom wall (23). Bottom wall (23) extends between front wall (17), rear wall (19), and sidewalls (21). Base (3) further comprises a set of four chamfered corners (20) where each sidewall (21) meets front wall (17) and rear wall (19). Chamfered corners (20) reinforce the walls and provide stability for container (1), particularly when other similar containers are stacked on top of container (1).

Front wall (17), rear wall (19), sidewalls (21), and bottom wall (23) cooperate to define a chamber (25) therebetween. Chamber (25) is configured to receive an item or items therein, such as produce or other edible foodstuffs. The nature of the items may be of the sort that may be eaten or removed in pieces or stages, such that a resealable containment of chamber (25) would be beneficial.

As shown in FIGS. 1 and 2, container (1) further comprises an inner lip (27) extending from base (3). Inner lip (27) defines a first resealing feature (29) having a first profile. Container (1) further comprises a lid (31) integral with base (3). Lid (31) is configured to move between an open position (FIG. 2) to reveal chamber (25) and a closed position (FIG. 1) to enclose chamber (25). As shown in FIGS. 1 and 2, lid (31) comprises an outer lip (33). Inner lip (27) is disposed between chamber (25) and outer lip (33) when lid (31) is in the closed position. Outer lip (33) defines a second resealing feature (35) having a second profile. In some versions of container (1), the first profile and the second profile are inverse profiles with respect to one another.

Some versions of first resealing feature (29) may comprise a male portion and some versions of first resealing feature (29) may comprise a female portion. In the embodiment shown in FIGS. 1-3A, first resealing feature (29) comprises a female portion (37). Similarly, some versions of second resealing feature (35) may comprise a male portion and some versions of second resealing feature (35) may comprise a female portion. In the embodiment shown in FIGS. 1-3A, second resealing feature (35) comprises a male portion (39).

Referring now to FIGS. 1-3A, first resealing feature (29) and second resealing feature (35) are configured to connect when lid (31) is moved from the open position to the closed position. In the illustrated embodiment, female portion (37) of first resealing feature (29) receives and/or frictionally engages male portion (39) of second resealing feature (35) therein when lid (31) is moved from the open position to the closed position. In some versions, male portion (39) may be positioned below and slightly misaligned with (e.g., horizontally offset/spaced apart from) female portion (37) when lid (31) is in the closed position such that an upper surface of male portion (39) at least partially abuts a lower surface of female portion (37) to further inhibit lid (31) from inadvertently moving toward the open position. The connection or locking engagement between female portion (37) and male portion (39) releasably locks lid (31) to base (3) with lid (31) in the closed position.

First resealing feature (29) and second resealing feature (35) are configured to disconnect when lid (31) is moved from the closed position to the open position. In the illustrated embodiment, male portion (39) of second resealing feature (35) moves out of female portion (37) of first resealing feature (29) when lid (31) is moved from the closed position to the open position. In some versions, first and/or second resealing features (29, 35) may be flexible to permit female and/or male portion (37, 39) to be flexed into and out of engagement with each other. For example, female portion (37) may be biased toward a flat, generally horizontal configuration, and may be flexible to permit temporary downward flexing of female portion (37) when lid (31) is moved from the open position to the closed position and/or to permit temporary upward flexing of female portion (37) when lid (31) is moved from the closed position to the open position. Likewise, male portion (39) may be biased toward a flat, generally horizontal configuration, and may be flexible to permit temporary upward flexing of male portion (39) when lid (31) is moved from the open position to the closed position and/or to permit temporary downward flexing of male portion (39) when lid (31) is moved from the closed position to the open position. The disconnection of female portion (37) and male portion (39) releases the locking engagement between lid (31) and base (3) and allows lid (31) to move to the open position.

Thus, first and second resealing features (29, 35) are defined by inner and outer lips (27, 33) themselves, respectively, and may selectively mechanically connect with each other to secure lid (31) in the closed position such that there is no need to apply any adhesive or other chemical substances between inner and outer lips (27, 33).

In some versions, female and male portions (37, 39) may cooperate with each other to generate a "click" sound when flexed into and/or out of engagement with each other. Such a click sound may provide an audibly discernible indication to the user that lid (31) has either been lockingly engaged with or lockingly disengaged from base (3). For example, when the user is moving lid (31) from the open position to the closed position, the click sound may provide an audibly discernible indication that lid (31) has been successfully lockingly engaged with base (3) for securely maintaining lid (31) in the closed position.

The first profile of first resealing feature (29) and the second profile of second resealing feature (35) may be inversely shaped with respect to one another. As described above, first resealing feature (29) may be generally male or female shaped, while second resealing feature (35) may be generally the inverse or opposite, such as a complementary-shaped male or female shaped.

Figure 4:
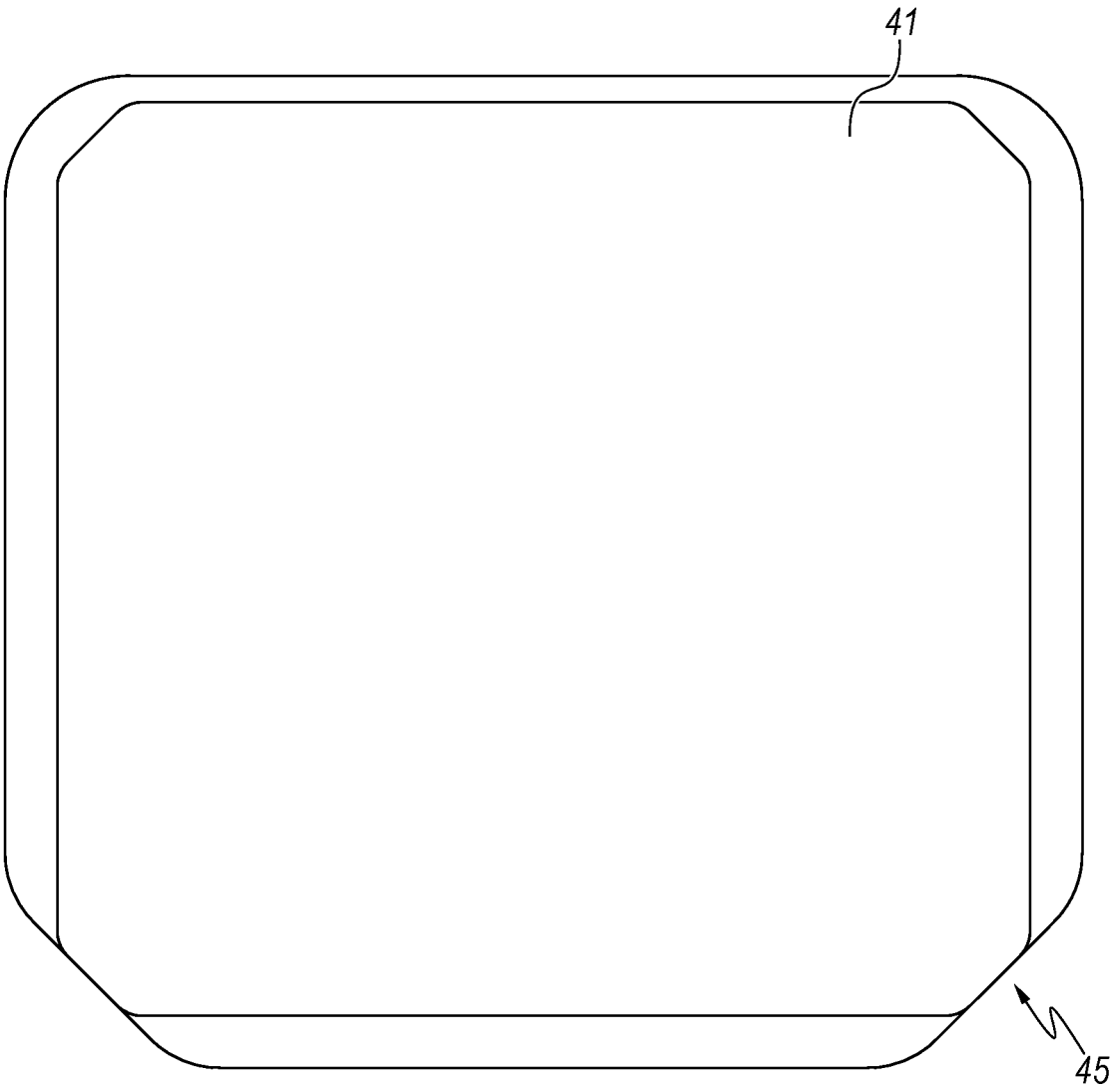
FIG. 4 depicts a top plan view of an exemplary film layer of the container of FIG. 1.

As shown in FIGS. 1 and 4, lid (31) further comprises a film layer (41) in accordance with the descriptions above. Film layer (41) is secured to outer lip (33) and generally extends across chamber (25) when lid (31) is in the closed position. In some versions, film layer (41) is not secured to inner lip (27) to allow lid (31) to move between the open position and the closed position. In other versions, film layer (41) may be initially removably secured to inner lip (27), and may be configured to peel away from inner lip (27) when lid (31) is first moved to the open position. In any event, film layer (41) abuts and lays overtop inner lip (27) in the closed position to facilitate the enclosure of chamber (25).

Lid (31) further comprises a rim (43) extending along outer lip (33). As shown in FIGS. 1 and 4, in some versions of lid (31), second resealing feature (35) is free of film layer (41) or film layer (41) otherwise terminates proximate second resealing feature (35). The absence of film layer (41) over second resealing feature (35) facilitates film layer (41) and rim (43) defining a vent (45) therebetween. Vent (45) allows a limited amount of air flow into and out of chamber (25) when lid (31) is in the closed position. Vent (45) further allows a limited amount of air flow generally vertically between top side (13) and bottom side (15) of container (1) through lid (31). This vertical air flow facilitates cooling and movement of air between multiple containers (1) when stacked together and on top of one another, for example.

Figure 5:
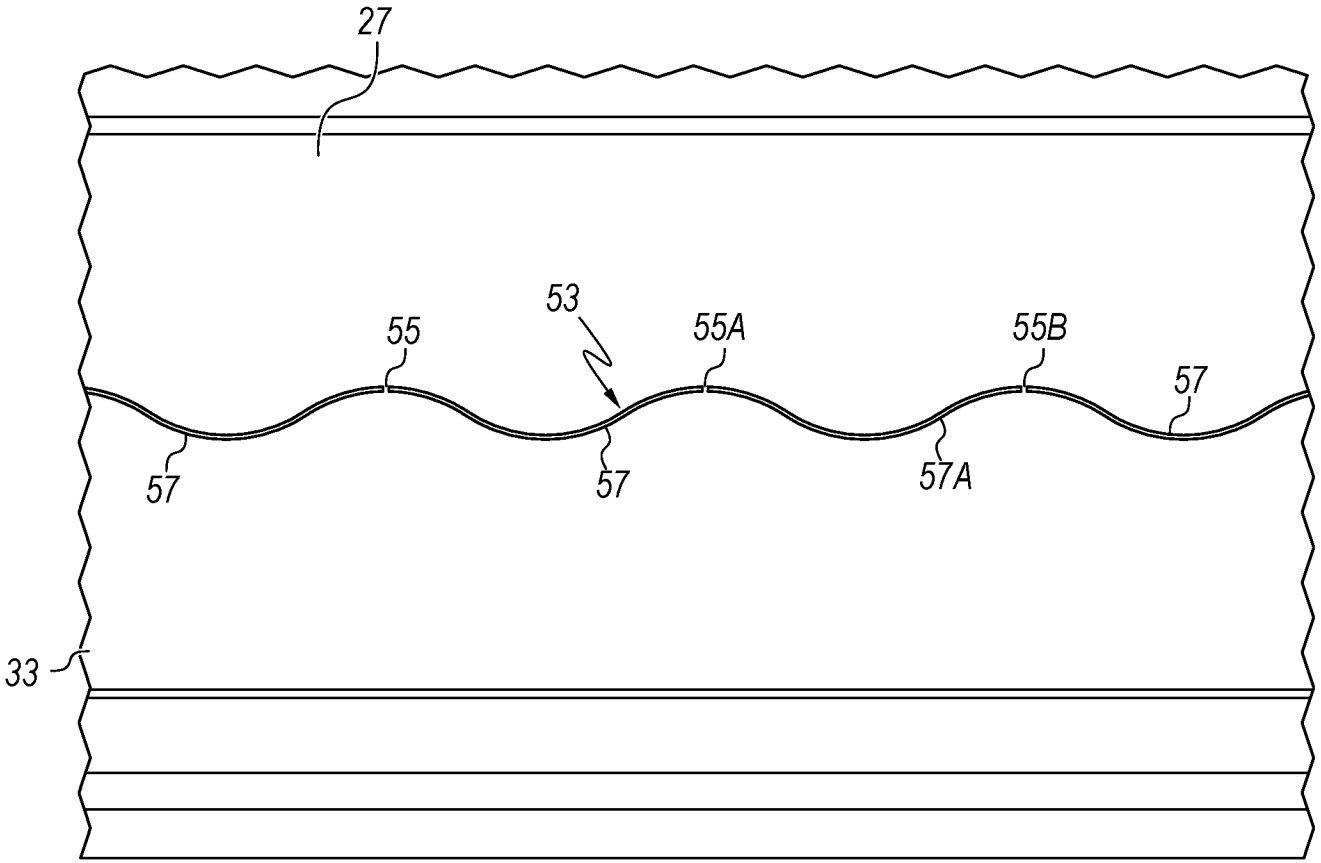
FIG. 5 depicts a top plan view of a separation cut used in the exemplary container of FIG. 1.

As best shown in FIG. 5, inner lip (27) and outer lip (33) define a separation cut (53) therebetween when lid (31) is in the closed position. In some versions of container (1), separation cut (53) is non-linear (e.g., serrated) and continues in a sinusoidal wave form. The non-linear form of separation cut (53) reduces the risk of a "paper cut" style injury to the user, as the wave form acts to prevent a continuous linear surface for the user to run a finger or hand along. Separation cut (53) also defines first resealing feature (29) and second resealing feature (35). Initially, container (1) is formed with a continuous non-separated lip (54) (FIG. 1), which is generally planar and is divided or otherwise cut into inner lip (27) and outer lip (33) as separation cut (53) is applied to container (1). Non-separated lip (54) remains in the areas of container (1) where separation cut (53) is not applied. For example, as seen in FIG. 2, non-separated lip (54) remains at rear side (11) of container (1).

In some versions of container (1), separation cut (53) is not initially continuous and comprises a plurality of perforations (57), each extending between and interspersed with corresponding attachment sections (55). For example, as shown in FIG. 5, perforation (57A) of separation cut (53) extends between attachment section (55A) and attachment section (55B). Perforations (57) may be formed in a pattern or non-linear configuration, such as a curved, serpentine, or sinusoidal wave shape. As shown in FIG. 5, perforation (57A) extends generally the distance of one wavelength of a sinusoidal wave shape. Attachment sections (55) are disposed generally between each perforation (57) and act to stabilize container (1) and hold inner lip (27) to outer lip (33) before container (1) is first opened by a user. When container (1) is opened for the first time by a user, attachment sections (55) break due to the opening forces applied by the user and release the attachment between inner lip (27) and outer lip (33), thus allowing lid (31) to move between the closed position and the open position. Attachment sections (55) are generally aligned with the terminating portion of two adjacent perforations (57) to facilitate and coordinate breaking the attachment section (55) along the path of perforations (57). For example, perforation (57A) is disposed between attachment section (55A) and attachment section (55B). As pressure is applied to outer lip (33), attachment sections (55A, 55B) break or tear along the path of perforation (57A). The destruction of each attachment section (55) connects the two adjacent perforations (57) and merges perforations (57) into a single elongated perforation, namely, separation cut (53).

In some versions of container (1), separation cut (53) and/or perforations (57) extends around approximately three-fourths of top side (13) while non-separated lip (54) extends around the other approximately one-fourth of top side (13). As shown in FIG. 1, separation cut (53) extends from a first location (59) to a second location (61). In order to facilitate lid (31) moving between the open position and the closed position, a first hinge (63) is disposed at first location (59) and a second hinge (65) is disposed at second location (61) to allow lid (31) to move about first hinge (63) and second hinge (65).

In the present example, first and second locations (59, 61) are positioned at or near adjacent, laterally-opposed corners (20) of base (3) that are proximate to rear side (11), such that separation cut (53) extends around approximately three-fourths of top side (13) and, more particularly, generally above both laterally-opposed sidewalls (21) and generally above front wall (17). First and second hinges (63, 65) are laterally opposed from each other generally above respective laterally-opposed sidewalls (21) such that a living hinge fold line (67) (FIG. 3) extends laterally along film layer (41) between first and second hinges (63, 65). More particularly, living hinge fold line (67) is generally parallel to front and rear walls (17, 19) and is generally perpendicular to both sidewalls (21). Thus, when lid (31) is in the open position, lid (31) may be spaced apart from both corners (20) of base (3) that are proximate to front side (9) while remaining secured to the remaining two corners (20) such that chamber (25) may be accessible between lid (31) and front wall (17) and/or between lid (31) and either sidewall (21). In this regard, resealing features (29, 35) are provided at or near both corners (20) of base (3) that are proximate to front side (9) to permit selective resealing of lid (31) to base (3) at or near such corners (20). Container (1) may therefore be referred to as having a "dual-corner breakaway" configuration.

During manufacturing of container (1), separation cut (53) and/or perforations (57) may be applied to container (1) prior to securing film layer (41) to outer lip (33). In some versions, film layer (41) may then be secured to outer lip (33) by heat sealing film layer (41) to outer lip (33). In order to avoid inadvertently heat sealing outer lip (33) to inner lip (27) across separation cut (53) and/or perforations (57) or otherwise undesirably deforming separation cut (53) and/or perforations (57) during such heat sealing of film layer (41) to outer lip (33), the sealing head component (not shown) of the heat sealing machine may be configured to apply the operative heat to film layer (41) and/or outer lip (33) at a predetermined distance outwardly and/or upwardly from separation cut (53) and/or perforations (57) for preventing a threshold amount of heat capable of sealing outer lip (33) to inner lip (27) from reaching separation cut (53) and/or perforations (57). For example, such a sealing head component may include a generally rectangular heating element corresponding to non-separated lip (54) for applying heat to film layer (41) and/or non-separated lip (54) along the portion of non-separated lip (54) remaining in the areas of container (1) where separation cut (53) is not applied. Such a sealing head component may also include one or more recessed portions corresponding to outer lip (33) configured to provide a clearance between the heating element and separation cut (53) and/or perforations (57) equal to or greater than the predetermined distance. These recessed portions may be generally sinusoidal to track separation cut (53) and/or perforations (57) such that the clearance provided between the heating element and separation cut (53) and/or perforations (57) is substantially constant, or may be generally straight/rectangular such that the clearance provided between the heating element and separation cut (53) and/or perforations (57) varies.

In this manner, the sealing head component may be configured to apply heat across substantially the full width of the portion of non-separated lip (54) remaining in the areas of container (1) where separation cut (53) is not applied, and to apply heat across only a portion of the width of outer lip (33) in the areas of container (1) where separation cut (53) is applied to ensure sufficient clearance between the heating element and separation cut (53) and/or perforations (57). In some versions, film layer (41) may be vertically offset from (e.g., spaced above) inner lip (27), as described below with respect to FIGS. 11-13. In cases where film layer (41) is initially removably secured to inner lip (27), such as via heat sealing, the recessed portion(s) may extend across separation cut (53) and/or perforations (57) to apply heat across only a portion of the width of inner lip (27) in the areas of container (1) where separation cut (53) is applied to ensure sufficient clearance between the heating element and separation cut (53) and/or perforations (57).

B. Second Exemplary Container

Figure 6:
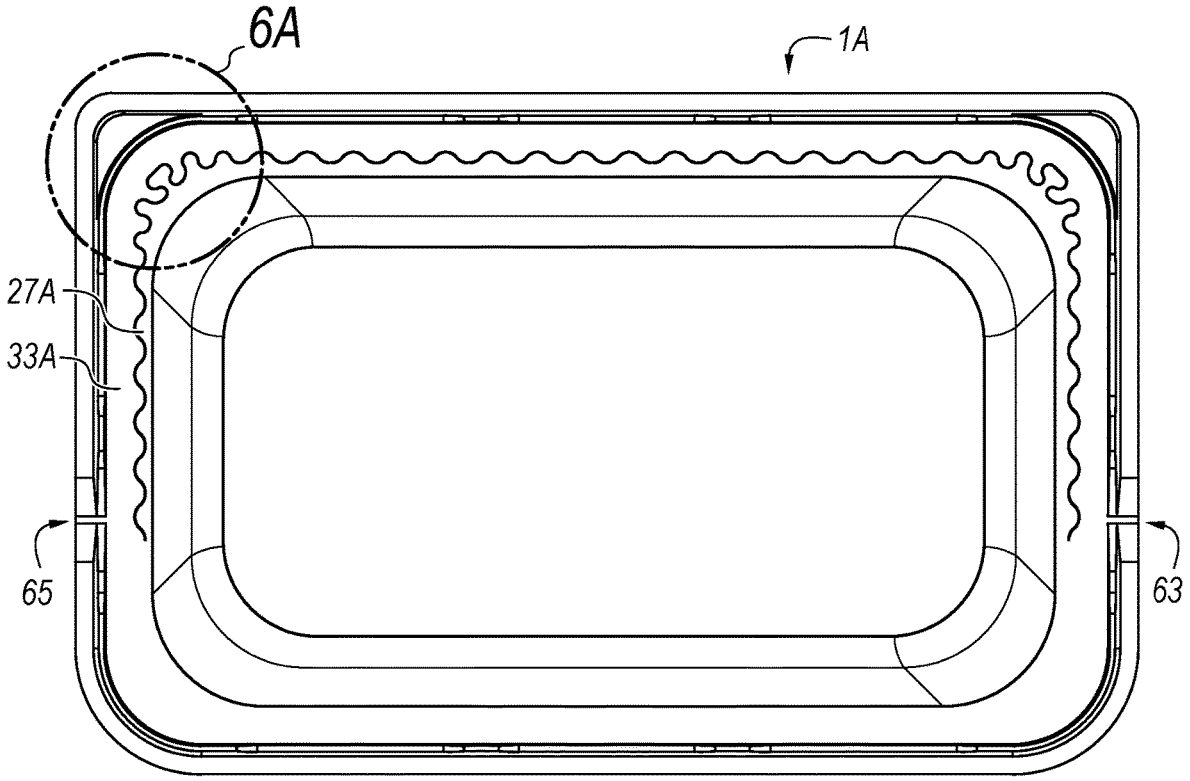
FIG. 6 depicts a top plan view of another exemplary container of the present invention in the closed position.
Figure 6A:
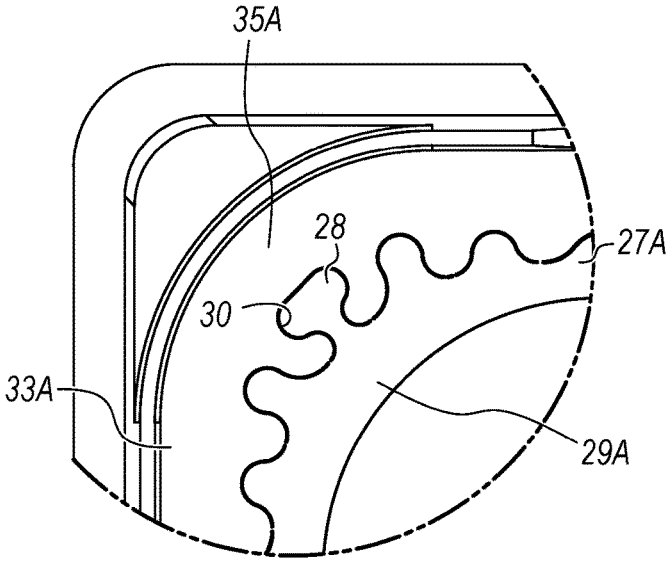
FIG. 6A depicts an enlarged view of a portion of the container of FIG. 6.

FIGS. 6 and 6A show another exemplary container (1A) similar to container (1) described above except as otherwise described below.

Rather than the general female shape of first resealing feature (29) and the general male shape of second resealing feature (35) of container (1), container (1A) has different profiles for the resealing features. Inner lip (27A) of container (1A) includes a first resealing feature (29A) having a general T-shaped projection (28) with adjacent recessed areas. Conversely, outer lip (33A) of container (1A) comprises a second resealing feature (35A) having a general T-shaped recess (30) defined by adjacent projections. T-shaped projection (28) is sized and shaped to be received in T-shaped recess (30) to create a locking engagement between lid (31) and base (3) as described above.

C. Third Exemplary Container

Figure 7:
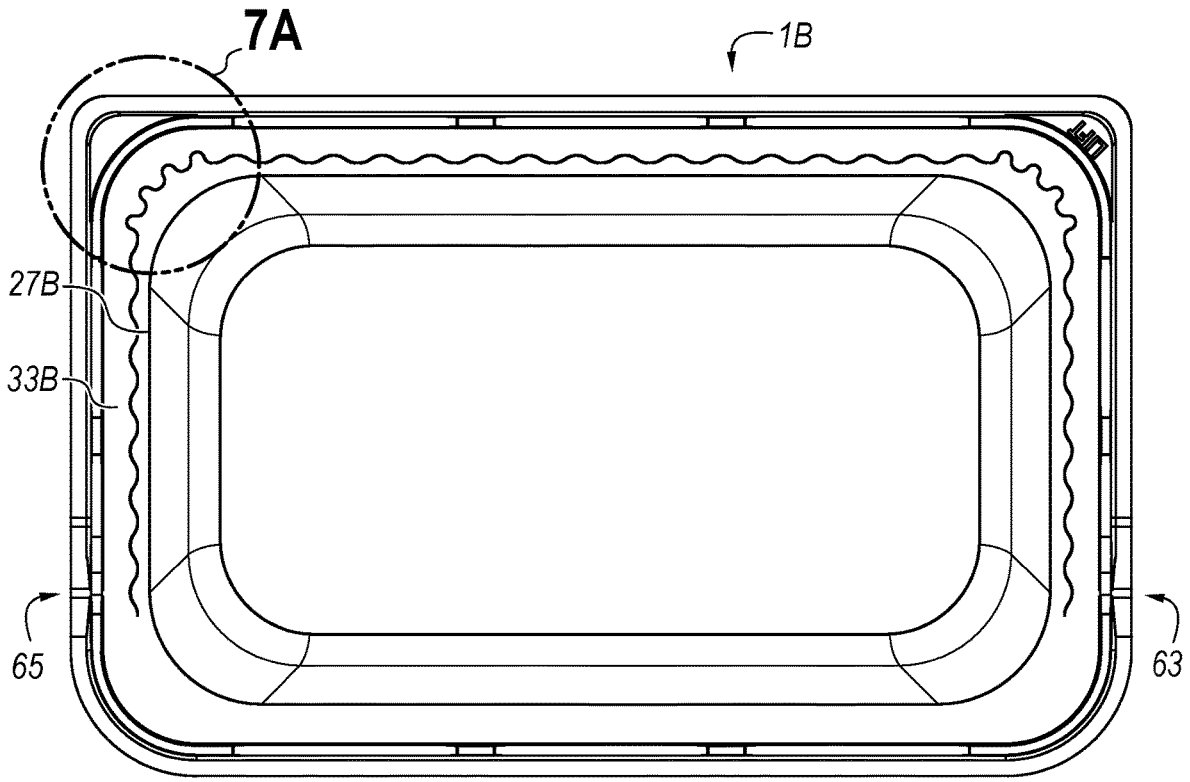
FIG. 7 depicts a top plan view of another exemplary container of the present invention in the closed position.
Figure 7A:
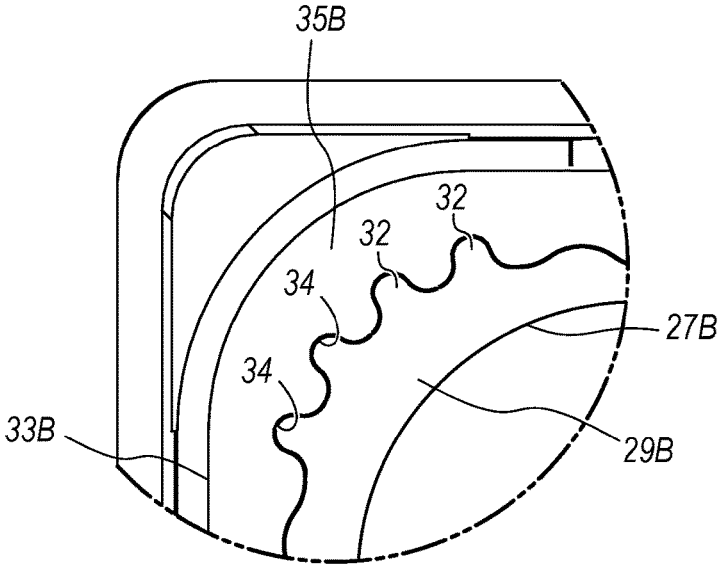
FIG. 7A depicts an enlarged view of a portion of the container of FIG. 7.

FIGS. 7 and 7A show another exemplary container (1B) similar to container (1) described above except as otherwise described below.

Similarly to container (1A), rather than the general female shape of first resealing feature (29) and the general male shape of second resealing feature (35) of container (1), container (1B) has different profiles for the resealing features. Inner lip (27B) of container (1B) includes a first resealing feature (29B) having a generally fan-shaped projection (32). Conversely, outer lip (33B) of container (1B) comprises a second resealing feature (35B) having a generally fan-shaped recess (34). Fan-shaped projection (32) is sized and shaped to be received in corresponding fan-shaped recess (34) to create a locking engagement between lid (31) and base (3) as described above.

In view of the multiple versions illustrated of first resealing feature (29, 29A, 29B) and second resealing feature (35, 35A, 35B), the present disclosure may encompass any shape, style, orientation, or profile of either first resealing feature (29, 29A, 29B) and/or second resealing feature (35, 35A, 35B).

D. Fourth Exemplary Container

Figure 8:
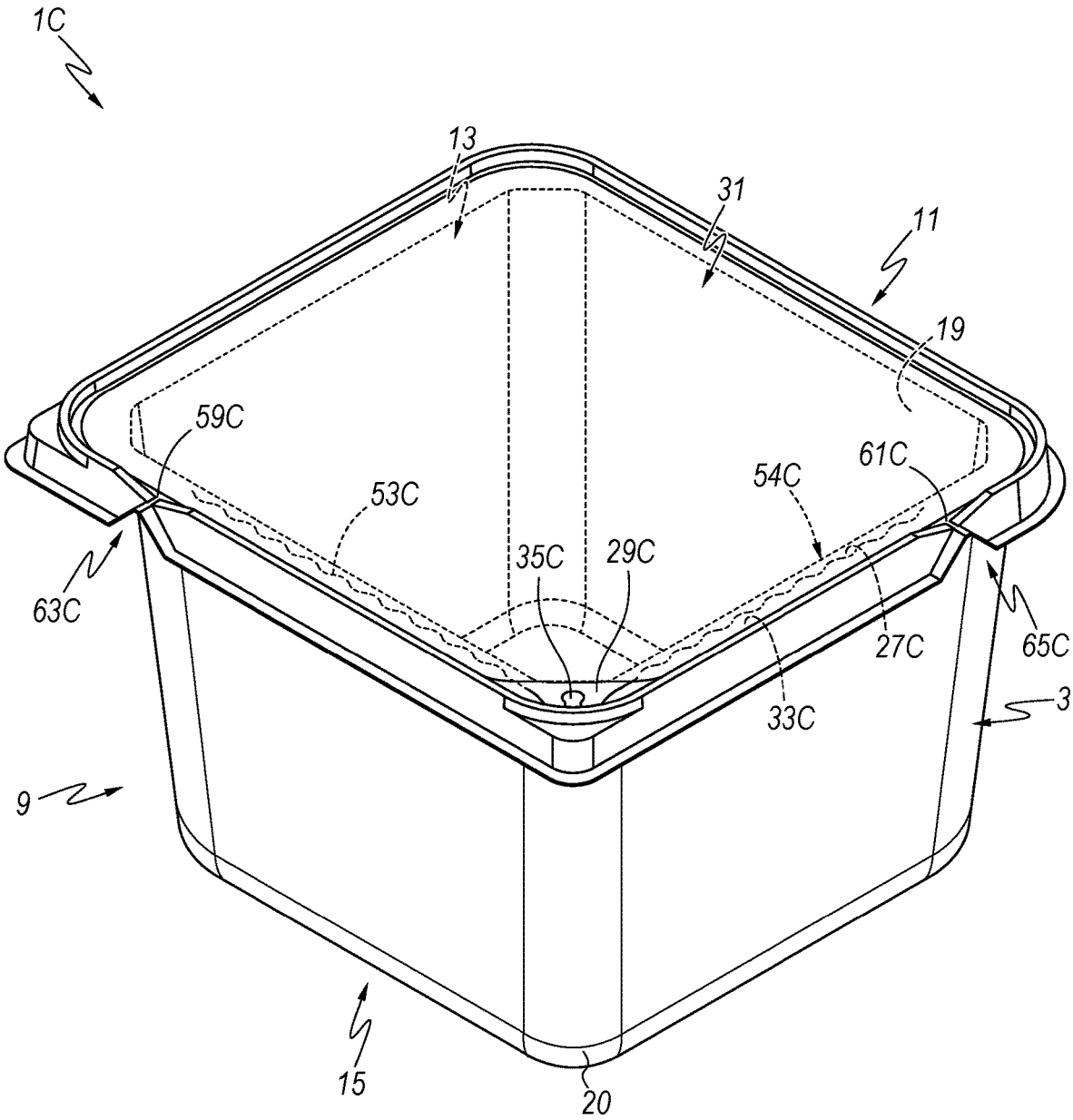
FIG. 8 depicts a perspective view of another exemplary container of the present invention in the closed position.
Figure 9:
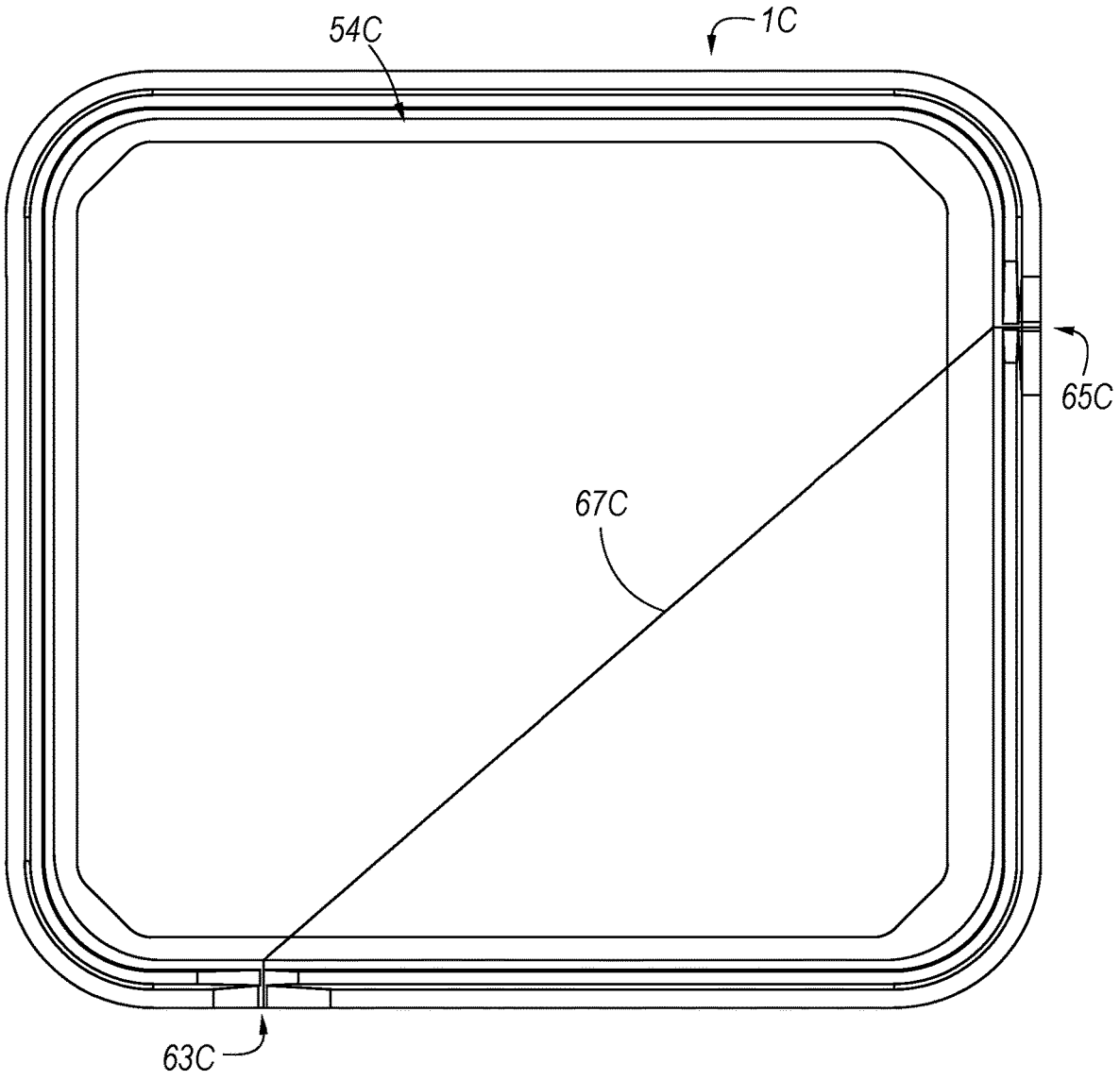
FIG. 9 depicts a top plan view of the container of FIG. 8.
Figure 10:
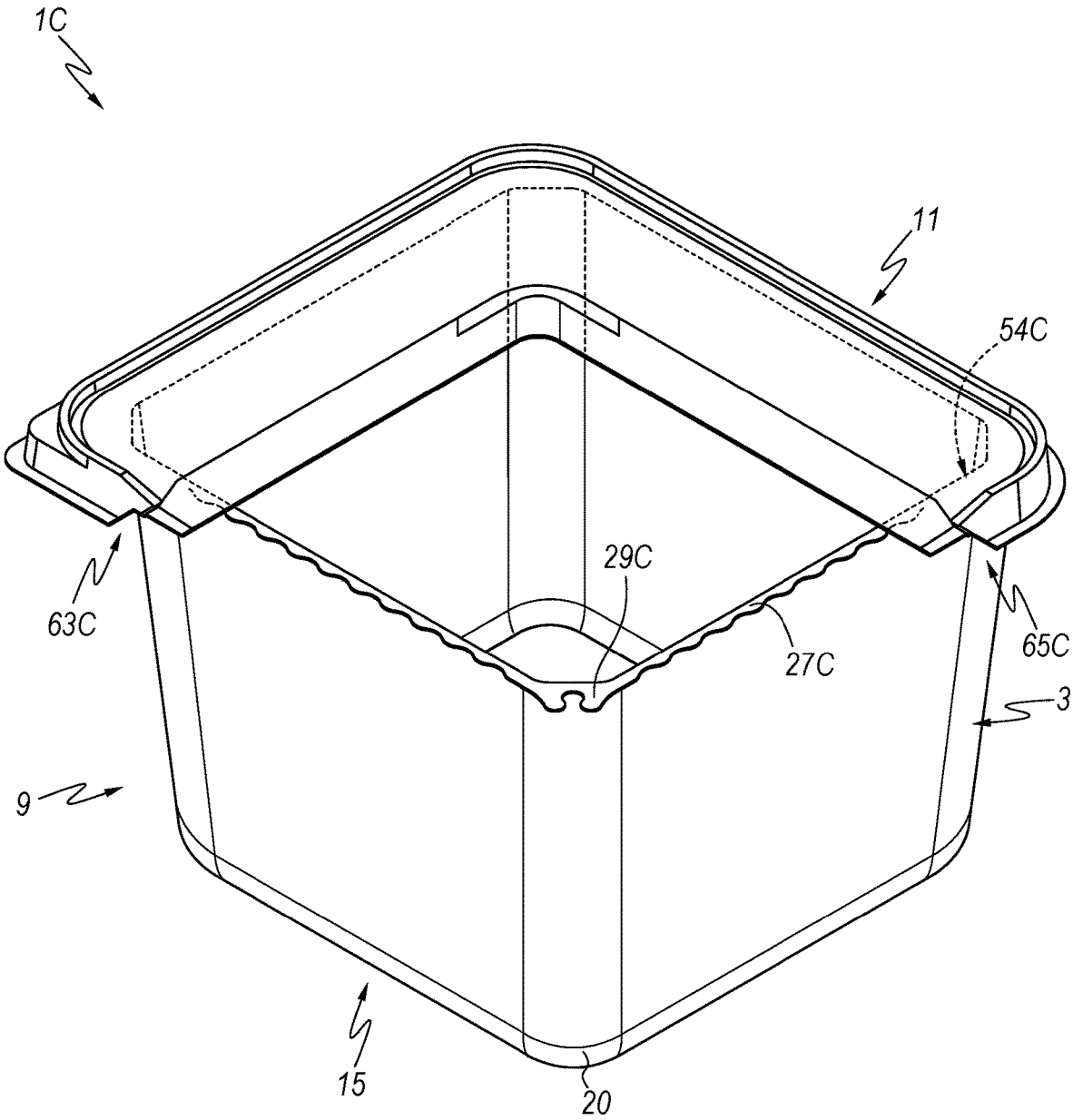
FIG. 10 depicts a perspective view of the container of FIG. 8 in the open position.

FIGS. 8-10 show another exemplary container (1C) similar to container (1) described above except as otherwise described below.

Rather than the dual-corner breakaway configuration of container (1), container (1C) has a "single-corner breakaway" configuration. More particularly, separation cut (53C) defined by inner lip (27C) and outer lip (33C) of container (1C) extends around approximately one-half of top side (13) while non-separated lip (54C) extends around the other approximately one-half of top side (13), remaining in the areas of container (1C) where separation cut (53C) is not applied. For example, as seen in FIG. 10, non-separated lip (54C) remains at rear side (11) of container (1C) and at one side between front and rear sides (9, 11).

As shown in FIG. 8, separation cut (53C) extends from a first location (59C) to a second location (61C). A first hinge (63C) is disposed at first location (59C) and a second hinge (65C) is disposed at second location (61C). In the present example, first and second locations (59C, 61C) are positioned at or near diagonally-opposed corners (20) of base (3), such that separation cut (53) extends around approximately one-half of top side (13) and, more particularly, generally above only one of laterally-opposed sidewalls (21) and generally above front wall (17). First and second hinges (63C, 65C) are diagonally opposed from each other generally above one of laterally-opposed sidewalls (21) and generally above front wall (17), respectively, such that a living hinge fold line (67C) (FIG. 9) extends diagonally along film layer (41) between first and second hinges (63C, 65C). More particularly, living hinge fold line (67) is generally transverse (e.g., oblique) to front and rear walls (17, 19) and to both sidewalls (21). Thus, when lid (31) is in the open position, lid (31) may be spaced apart from only one select corner (20) of base (3) that is proximate to front side (9) while remaining secured to the remaining three corners (20) such that chamber (25) may be accessible between lid (31) and front wall (17) and/or between lid (31) and only one sidewall (21). In this regard, resealing features (29C, 35C) generally similar to resealing features (29, 35) described above are provided at or near only the select corner (20) of base (3) that is proximate to front side (9) to permit selective resealing of lid (31) to base (3) at or near such select corner (20). It will be appreciated that resealing features (29C, 35C) may be configured in any other suitable manner, such as similarly to any one or more of resealing features (29A, 35A, 29B, 35B) described above.

E. Fifth Exemplary Container

Figure 11:
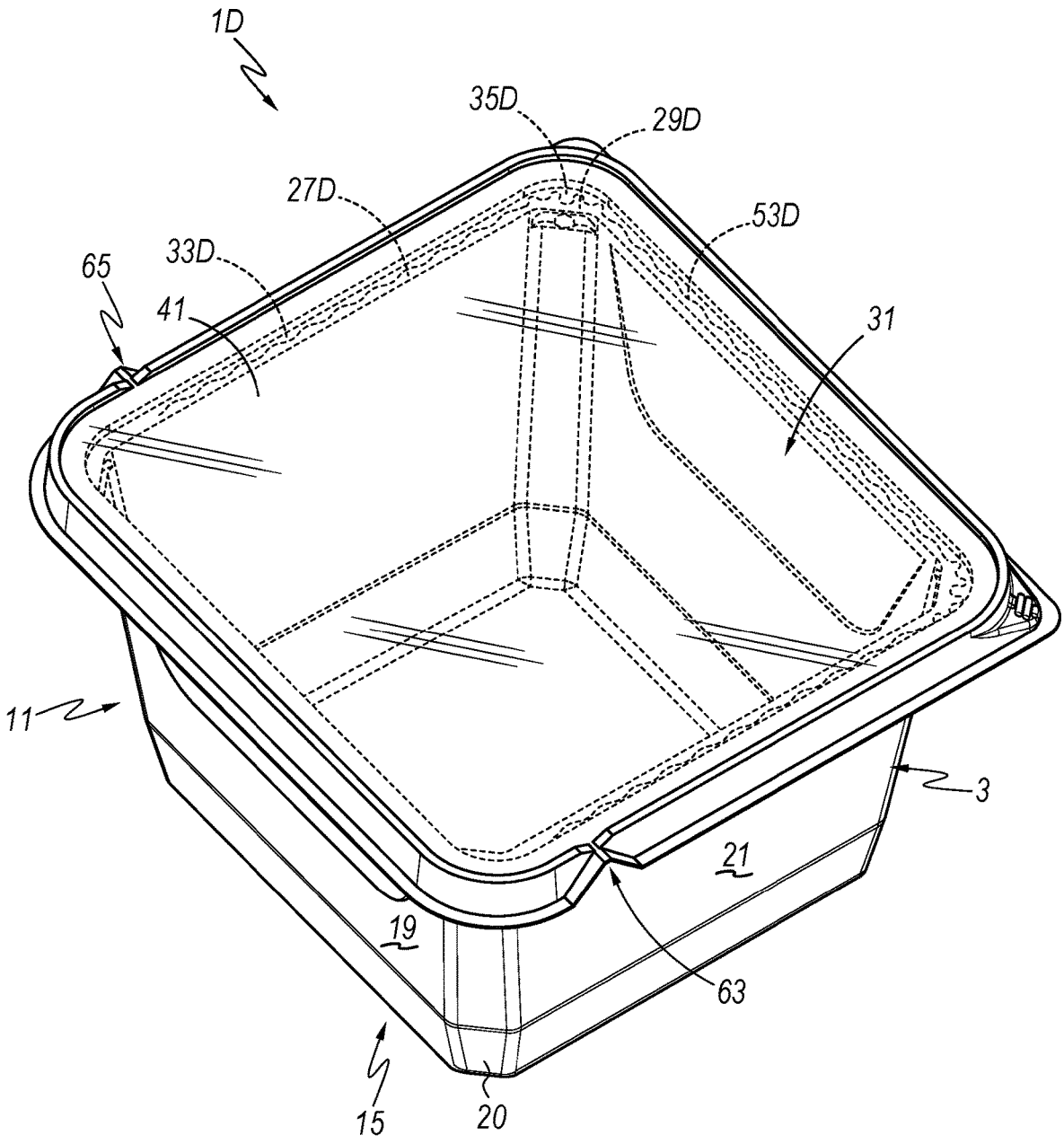
FIG. 11 depicts a perspective view of another exemplary container of the present invention in the closed position.
Figure 12:
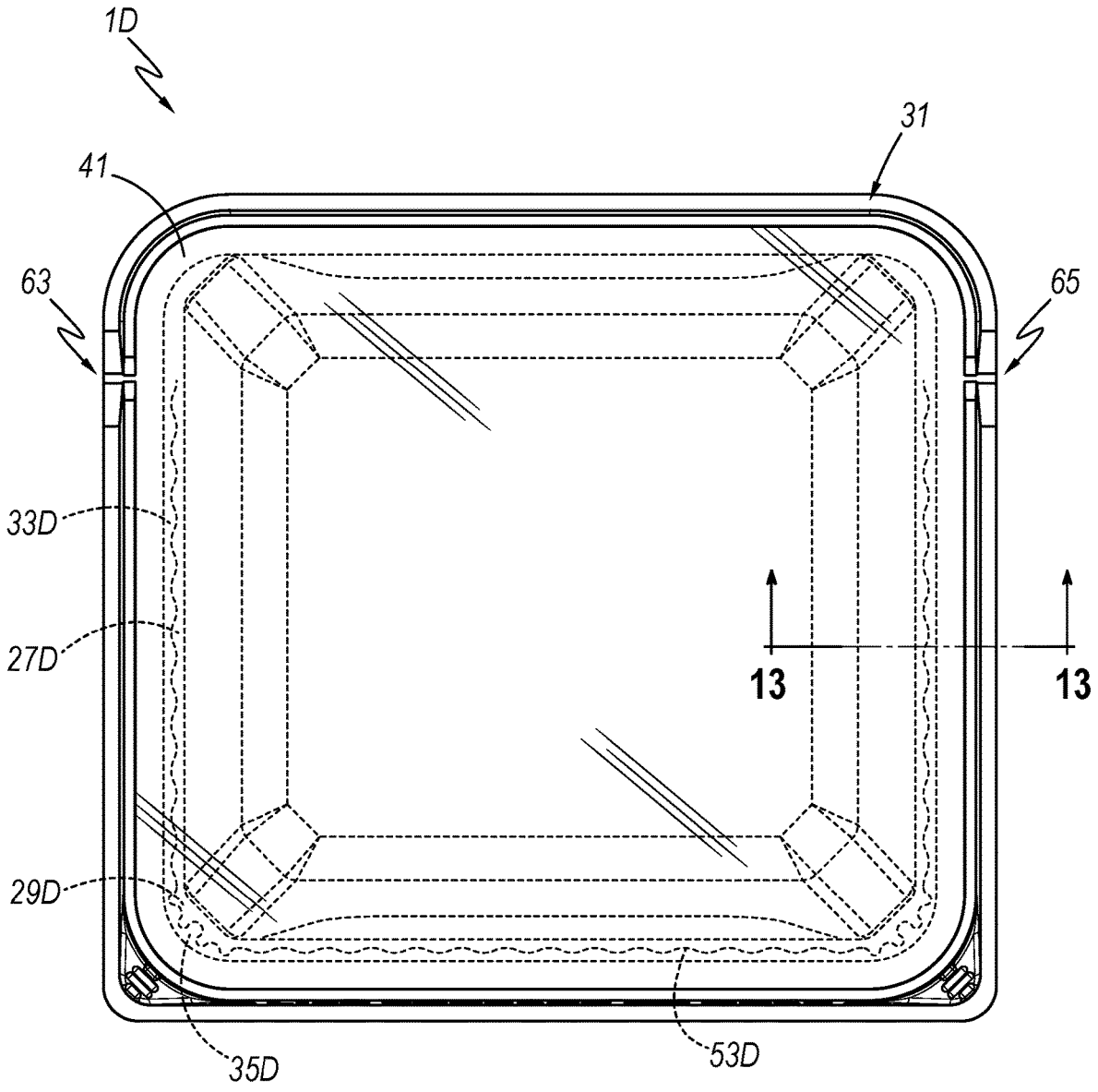
FIG. 12 depicts a top plan view of the container of FIG. 11.
Figure 13:
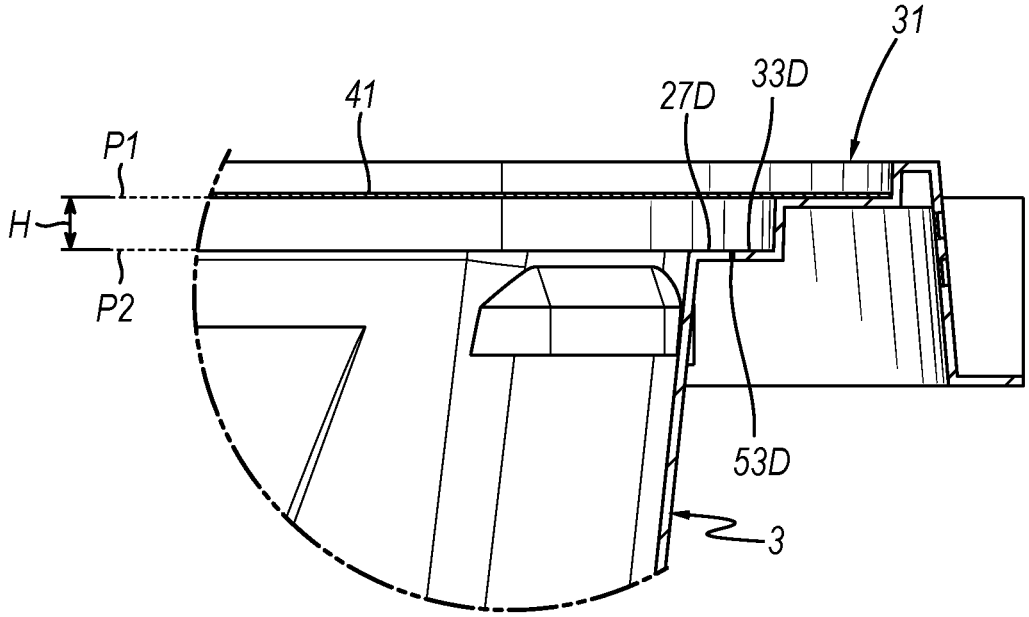
FIG. 13 depicts a cross-sectional view of the container of FIG. 11, taken along section line 13-13 in FIG. 12.

FIGS. 11-13 show another exemplary container (1D) similar to container (1) described above except as otherwise described below.

Inner lip (27D) of container (1D) includes a first resealing feature (29D) and outer lip (33D) of container (1D) includes a second resealing feature (35D). Film layer (41) is secured to outer lip (33D), and inner lip (27D) and outer lip (33D) define a separation cut (53D) therebetween when lid (31) is in the closed position.

As best shown in FIG. 13, outer lip (33D) has a stepped, bilevel configuration, with film layer (41) secured to a radially outward, vertically upward portion of outer lip (33D) defining a first horizontal plane (P1), and with separation cut (53D) defined between inner lip (27D) and a radially inward, vertically downward portion of outer lip (33D) defining a second horizontal plane (P2) below first horizontal plane (P1). Thus, film layer (41) and, more particularly, the outer peripheral portion of film layer (41) which is secured to outer lip (33D), is positioned within the first horizontal plane (P1), while separation cut (53D) is positioned within the second horizontal plane (P2), such that at least the outer peripheral portion of film layer (41) is above separation cut (53D). In the example shown, the first and second horizontal planes (P1, P2) are vertically offset (e.g., spaced apart) from each other by a height (H).

In some versions, height (H) may be sized to provide clearance between film layer (41) and inner lip (27D) during movement of lid (31) from the open position to the closed position for connecting first resealing feature (29D) and second resealing feature (35D). In this regard, it may be desirable during such movement of lid (31) to pass second resealing feature (35D) below first resealing feature (29D) to permit an upper surface of second resealing feature (35D) to at least partially abut a lower surface of first resealing feature (29D) to inhibit lid (31) from inadvertently moving toward the open position, as described above with respect to FIGS. 1-3A. The clearance provided by height (H) may be sufficient to prevent film layer (41) from impacting inner lip (27D) when second resealing feature (35D) is passed below first resealing feature (29D) to achieve such relative positioning between first and second resealing features (29D, 35D).

In addition or alternatively, height (H) may be sized to prevent film layer (41) from being inadvertently heat sealed to inner lip (27D) across separation cut (53) during heat sealing of film layer (41) to outer lip (33D). In this regard, height (H) may be sufficiently great to prevent a threshold amount of heat capable of sealing film layer (41) to inner lip (27D) from reaching separation cut (53D) and/or inner lip (27D) during application of the operative heat to film layer (41) and/or outer lip (33D) for heat sealing film layer (41) to outer lip (33D). In some examples, height (H) may be approximately 0.09 inch.

While container (1D) is illustrated as having a dual-corner breakaway configuration similar to that of container (1), it will be appreciated that container (1D) may alternatively have a single-corner breakaway configuration similar to that of container (1C). In some versions, separation cut (53D) may extend around an entirety of top side (13) and hinges (63, 65) may be omitted, such that container (1D) may have a full-breakaway configuration with lid (31) being fully removable from base (3).

As described above, the present disclosure includes container (1, 1A, 1B, 1C, 1D) comprising base (3) defining chamber (25); inner lip (27, 27A, 27B, 27C, 27D) extending from base (3); first resealing feature (29, 29A, 29B, 29C, 29D) defined by inner lip (27, 27A, 27B, 27C, 27D); outer lip (33, 33A, 33B, 33C, 33D) configured to move between an open position and a closed position, wherein inner lip (27, 27A, 27B, 27C, 27D) is disposed between outer lip (33, 33A, 33B, 33C, 33D) and chamber (25) when outer lip (33, 33A, 33B, 33C, 33D) is in the closed position; second resealing feature (35, 35A, 35B, 35C, 35D) defined by outer lip (33, 33A, 33B, 33C, 33D), wherein first resealing feature (29, 29A, 29B, 29C, 29D) and second resealing feature (35, 35A, 35B, 35C, 35D) are configured to connect when outer lip (33, 33A, 33B, 33C, 33D) is moved from the open position to the closed position, and wherein first resealing feature (29, 29A, 29B, 29C, 29D) and second resealing feature (35, 35A, 35B, 35C, 35D) are configured disconnect when outer lip (33, 33A, 33B, 33C, 33D) is moved from the closed position to the open position.

In furtherance of the above, a method of forming container (1, 1A, 1B, 1C, 1D) may include the steps of: (a) applying separation cut (53) to non-separated lip (54) extending from base (3) defining chamber (25), wherein separation cut (53) separates non-separated lip (54) into inner lip (27, 27A, 27B, 27C, 27D) and outer lip (33, 33A, 33B, 33C, 33D), wherein inner lip (27, 27A, 27B, 27C, 27D) extends from base (3), wherein outer lip (33, 33A, 33B, 33C, 33D) is movable between the open position and the closed position; (b) defining first resealing feature (29, 29A, 29B, 29C, 29D) by separation cut (53), wherein inner lip (27, 27A, 27B, 27C, 27D) comprises first resealing feature (29, 29A, 29B, 29C, 29D); (c) defining second resealing feature (35, 35A, 35B, 35C, 35D) by separation cut (53), wherein outer lip (33, 33A, 33B, 33C, 33D) comprises second resealing feature (35, 35A, 35B, 35C, 35D); (d) connecting first resealing feature (29, 29A, 29B, 29C, 29D) and second resealing feature (35, 35A, 35B, 35C, 35D) when outer lip (33, 33A, 33B, 33C, 33D) moves from the open position to the closed position; and (e) disconnecting first resealing feature (29, 29A, 29B, 29C, 29D) and second resealing feature (35, 35A, 35B, 35C, 35D) when outer lip (33, 33A, 33B, 33C, 33D) moves from the closed position to the open position.

IV. Exemplary Combinations

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

Example 1

A container comprising: (a) a base defining a chamber; (b) an inner lip extending from the base; (c) a first resealing feature defined by the inner lip; and (d) a lid integral with the base, wherein the lid is configured to move between an open position to reveal the chamber and a closed position to enclose the chamber, the lid further comprising: (i) an outer lip, wherein the inner lip is disposed between the outer lip and the chamber when the lid is in the closed position, and (ii) a second resealing feature defined by the outer lip, wherein the first resealing feature and the second resealing feature are configured to connect when the lid is moved from the open position to the closed position, and wherein the first resealing feature and the second resealing feature are configured to disconnect when the lid is moved from the closed position to the open position.

Example 2

The container of Example 1 or any of the subsequent Examples, wherein one of the first resealing feature and the second resealing feature comprise a male portion.

Example 3

The container of any of the previous or subsequent Examples, wherein the other one of the first resealing feature and the second resealing feature comprise a female portion configured to receive the male portion therein when the lid is moved from the open position to the closed position.

Example 4

The container of any of the previous or subsequent Examples, wherein the lid comprises a film layer.

Example 5

The container of any of the previous or subsequent Examples, wherein the film layer is secured to the outer lip.

Example 6

The container of any of the previous or subsequent Examples, wherein the film layer is vertically offset from the inner lip.

Example 7

The container of any of the previous or subsequent Examples, further comprising: (a) a rim extending along the outer lip; (b) a vent, wherein the vent is defined between the film layer and the rim.

Example 8

The container of any of the previous or subsequent Examples, wherein the second resealing feature is disposed in the vent.

Example 9

The container of any of the previous or subsequent Examples, wherein the inner lip and the outer lip define a separation cut therebetween when the lid is in the closed position.

Example 10

The container of any of the previous or subsequent Examples, wherein the separation cut is non-linear.

Example 11

The container of any of the previous or subsequent Examples, wherein the separation cut defines the first resealing feature.

Example 12

The container of any of the previous or subsequent Examples, wherein the separation cut defines the second resealing feature.

Example 13

The container of any of the previous or subsequent Examples, wherein the lid further comprises a first hinge disposed at a first location, wherein the lid pivots about the first hinge when moving between the open position and the closed position, wherein the separation cut extends from the first location.

Example 14

The container of any of the previous or subsequent Examples, wherein the lid further comprises a second hinge disposed at a second location, wherein the lid pivots about the second hinge when moving between the open position and the closed position, wherein the separation cut extends from the first location to the second location.

Example 15

The container of any of the previous or subsequent Examples, wherein the separation cut comprises a plurality of perforations.

Example 16

The container of any of the previous or subsequent Examples, wherein the first resealing feature comprises a first profile, wherein the second resealing feature comprises a second profile, wherein the first profile is the inverse of the second profile.

Example 17

A container comprising: (a) a base defining a chamber; (b) an inner lip extending from the base; (c) a first resealing feature defined by the inner lip; (d) an outer lip configured to move between and open position and a closed position, wherein the inner lip is disposed between the outer lip and the chamber when the outer lip is in the closed position; (e) a second resealing feature defined by the outer lip, wherein the first resealing feature and the second resealing feature are configured to connect when the outer lip is moved from the open position to the closed position, and wherein the first resealing feature and the second resealing feature are configured disconnect when the outer lip is moved from the closed position to the open position.

Example 18

The container of any of the previous or subsequent Examples, further comprising: (a) a rim, wherein the outer lip extends from the rim, wherein the outer lip is disposed between the inner lip and the rim when the outer lip is in the closed position; and (b) a vent, wherein the vent is at least partially defined by the rim.

Example 19

The container of any of the previous or subsequent Examples, further comprising a film layer, wherein the film layer is secured to one or both of the outer lip and the rim, wherein the vent is defined by the film layer and the rim.

Example 20

A method of forming a container comprising: (a) applying a separation cut to a lip extending from a base defining a chamber, wherein the separation cut separates the lip into an inner lip and an outer lip, wherein the inner lip extends from the base, wherein the outer lip is movable between an open position and a closed position; (b) defining a first resealing feature by the separation cut, wherein the inner lip comprises the first resealing feature; (c) defining a second resealing feature by the separation cut, wherein the outer lip comprises the second resealing feature; (d) connecting the first resealing feature and the second resealing feature when the outer lip moves from the open position to the closed position; and (e) disconnecting the first resealing feature and the second resealing feature when the outer lip moves from the closed position to the open position.

V. Miscellaneous

It should be understood that any of the examples described herein may include various other features in addition to or in lieu of those described above. By way of example only, any of the examples described herein may also include one or more of the various features disclosed in any of the various references that are incorporated by reference herein.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various versions of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A container comprising:

(a) a base defining a chamber;

(b) an inner lip extending from the base;

(c) a first resealing feature defined by the inner lip;

(d) a lid integral with the base, wherein the lid is configured to move between an open position to reveal the chamber and a closed position to enclose the chamber, the Id further comprising:

(i) an outer lip, wherein the inner lip is disposed between the outer lip and the chamber when the lid is in the closed position, (ii) a second resealing feature defined by the outer lip, and (iii) a film layer, wherein the first resealing feature and the second resealing feature are configured to connect with each other when the lid is moved from the open position to the closed position, and wherein the first resealing feature and the second resealing feature are configured to disconnect from each other when the lid is moved from the closed position to the open position; and (e) a rim extending along the outer lip; and (f) a vent, wherein the vent is defined by the film layer and the rim, wherein the inner lip and the outer lip define a separation cut therebetween when the lid is in the closed position.

2. The container of claim 1, wherein one of the first resealing feature and the second resealing feature comprise a male portion.

3. The container of claim 2, wherein the other one of the first resealing feature and the second resealing feature comprise a female portion configured to receive the male portion therein when the lid is moved from the open position to the closed position.

4. The container of claim 1, wherein the film layer is secured to the outer lip.

5. The container of claim 1, wherein the film layer is vertically offset from the inner lip.

6. The container of claim 1, wherein the second resealing feature is disposed in the vent.

7. The container of claim 1, wherein the separation cut is non-linear.

8. The container of claim 1, wherein the separation cut defines the first resealing feature.

9. The container of claim 1, wherein the separation cut defines the second resealing feature.

10. The container of claim 1, wherein the lid further comprises a first hinge disposed at a first location, wherein the lid pivots about the first hinge when moving between the open position and the closed position, wherein the separation cut extends from the first location.

11. The container of claim 10, wherein the lid further comprises a second hinge disposed at a second location, wherein the lid pivots about the second hinge when moving between the open position and the closed position, wherein the separation cut extends from the first location to the second location.

12. The container of claim 1, wherein the separation cut comprises a plurality of perforations.

13. The container of claim 1, wherein the first resealing feature comprises a first profile, wherein the second resealing feature comprises a second profile, wherein the first profile is an inverse of the second profile.

14. A container comprising:

(a) a base defining a chamber;

(b) an inner lip extending from the base;

(c) a first resealing feature defined by the inner lip;

(d) an outer lip configured to move between an open position and a closed position, wherein the inner lip is disposed between the outer lip and the chamber when the outer lip is in the closed position;

(e) a second resealing feature defined by the outer lip, wherein the first resealing feature and the second resealing feature are configured to connect with each other when the outer lip is moved from the open position to the closed position, and wherein the first resealing feature and the second resealing feature are configured disconnect from each other when the outer lip is moved from the closed position to the open position; and (f) a rim, wherein the outer lip extends from the rim, wherein the outer lip is disposed between the inner lip and the rim when the outer lip is in the closed position; and (g) a vent, wherein the vent is at least partially defined by the rim and the second resealing feature.

15. The container of claim 14, further comprising a film layer, wherein the film layer is secured to one or both of the outer lip and the rim, wherein the vent is defined by the film layer and the rim.

16. A container comprising:

(a) a base defining a chamber;

(b) a first lip extending from the base;

(c) a lid including a second lip configured to move between an open position to reveal the chamber and a closed position to enclose the chamber, wherein the lid includes a film layer;

(d) a rim extending along the second lip and including a first hinge and a second hinge; and (e) a vent at least partially defined by the rim, wherein the film layer includes a living hinge extending between the first and second hinges of the rim, wherein the film layer is configured to fold at the living hinge as the lid selectively moves from the closed position to the own position.

17. The container of claim 16, further comprising:

(a) a first resealing feature defined by the first lip; and (b) a second resealing feature defined by the second lip;

wherein the first resealing feature and the second resealing feature are configured to connect with each other when the second lip is moved from the open position to the closed position, and wherein the first resealing feature and the second resealing feature are configured disconnect from each other when the second lip is moved from the closed position to the open position.

18. The container of claim 16, wherein the first lip is an inner lip, and wherein the second lip is an outer lip.

19. The container of claim 16, further comprising a film layer, wherein the vent is defined between the film layer and the rim.

* * * * *